United States Patent [19]

Wakana et al.

[11] 4,279,966

[45] Jul. 21, 1981

[54] PRESSURE RESISTANT SQUARE PANEL

[75] Inventors: Hiroshi Wakana, Fuchu; Shigeru Yamada, Kiyose; Akira Sato, Higashimurayama, all of Japan

[73] Assignee: Bridgestone Tire Co., Ltd., Tokyo, Japan

[21] Appl. No.: 27,702

[22] Filed: Apr. 6, 1979

[30] Foreign Application Priority Data

Apr. 10, 1978 [JP] Japan ..... 53-45894[U]

[51] Int. Cl.[3] ..... E04C 2/32; E04C 2/50

[52] U.S. Cl. ..... 428/595; 428/604; 52/603

[58] Field of Search ..... 428/604, 595; 52/603

[56] References Cited

U.S. PATENT DOCUMENTS

| | | | |
|---|---|---|---|
| 1,151,375 | 8/1915 | Murphy | 52/630 |
| 1,182,147 | 5/1916 | Dake | 52/630 |
| 1,244,806 | 10/1917 | Weisbrod | 52/630 |
| 2,217,110 | 10/1940 | Gilpin | 52/630 |
| 2,611,454 | 9/1952 | Arehart et al. | 52/630 |
| 3,408,779 | 11/1968 | Allen et al. | 52/630 |
| 3,420,012 | 1/1969 | Liskey, Jr. et al. | 52/630 |
| 3,696,578 | 10/1972 | Swensen et al. | 52/630 |

FOREIGN PATENT DOCUMENTS

| | | | |
|---|---|---|---|
| 2387331 | 11/1978 | France | 52/630 |

*Primary Examiner*—Brooks H. Hunt

*Attorney, Agent, or Firm*—Sughrue, Rothwell, Mion, Zinn and Macpeak

[57] ABSTRACT

A pressure resistant square panel made of steel or cast iron comprises flanges extending along peripheral edges of a pressure receiving surface of the panel, a bottom portion along bottom edges of the flanges of the pressure receiving surface, flat portions inside the bottom portion and higher therethan, and reinforcing ribs substantially X-shaped as viewed in a plan view and extending along diagonals of the panel and progressively increasing their heights from corners to a center of the panel.

13 Claims, 6 Drawing Figures

PRESSURE RESISTANT SQUARE PANEL

BACKGROUND OF THE INVENTION

1. Field of the Invention

This invention relates to a pressure resistant square panel made of steel or cast iron and more particularly to a pressure resistant square steel or iron panel for use in panel assembled water tanks.

2. Description of the Prior Art

Panel assembled water tanks have been widely used, located at high levels as for example on roofs of high buildings for water reservoirs or underground for waste water. Plastic coated steel panels or glass fiber reinforced plastic panels have been preferably used for the panel assembled water tanks. Steel panels inter alia are suitable for large water tanks because of their conspicuous strength. Such steel panels are usually formed in their pressure receiving square surfaces with reinforcing ribs for the purpose of further increasing the pressure resistance of the panels by reducing deformations to much smaller values which would be caused by the water whose pressure tends to bulge the panels of the assembled tanks. The reinforcing ribs are generally often formed along their diagonals in substantially X-shaped ribs as viewed in planes in order to facilitate manufacturing the panels. However, the steel panels reinforced by ribs hitherto used are not necessarily satisfactory in strength characteristics required for assembled tanks. On the other hand, panel assembled tanks have become progressively larger according to requirements. Under such conditions it has been expected to develop higher pressure resistant panels suitable for panel assembled tanks.

SUMMARY OF THE INVENTION

It is an object of the present invention to provide a steel or cast iron panel having a higher strength than those of the prior art.

In order to fulfill this object, the higher strength panel made of steel or cast iron including reinforcing ribs extending from corners to a center of said panel to form a substantially X-shaped rib as viewed in a plane of the panel, and flanges extending in a uniform height along peripheral edges of a pressure receiving square surface of the panel. According to the present invention, the pressure receiving surface comprises a bottom portion along bottom edges of said flanges of said pressure receiving square surface and flat portions slightly higher than and inside said bottom portion, said reinforcing ribs being formed progressively higher from said corners toward the center of the panel.

The invention will be more fully understood by referring to the following detailed specification and claims taken in connection with the appended drawings.

DESCRIPTION OF THE PREFERRED EMBODIMENT

Figure 1:
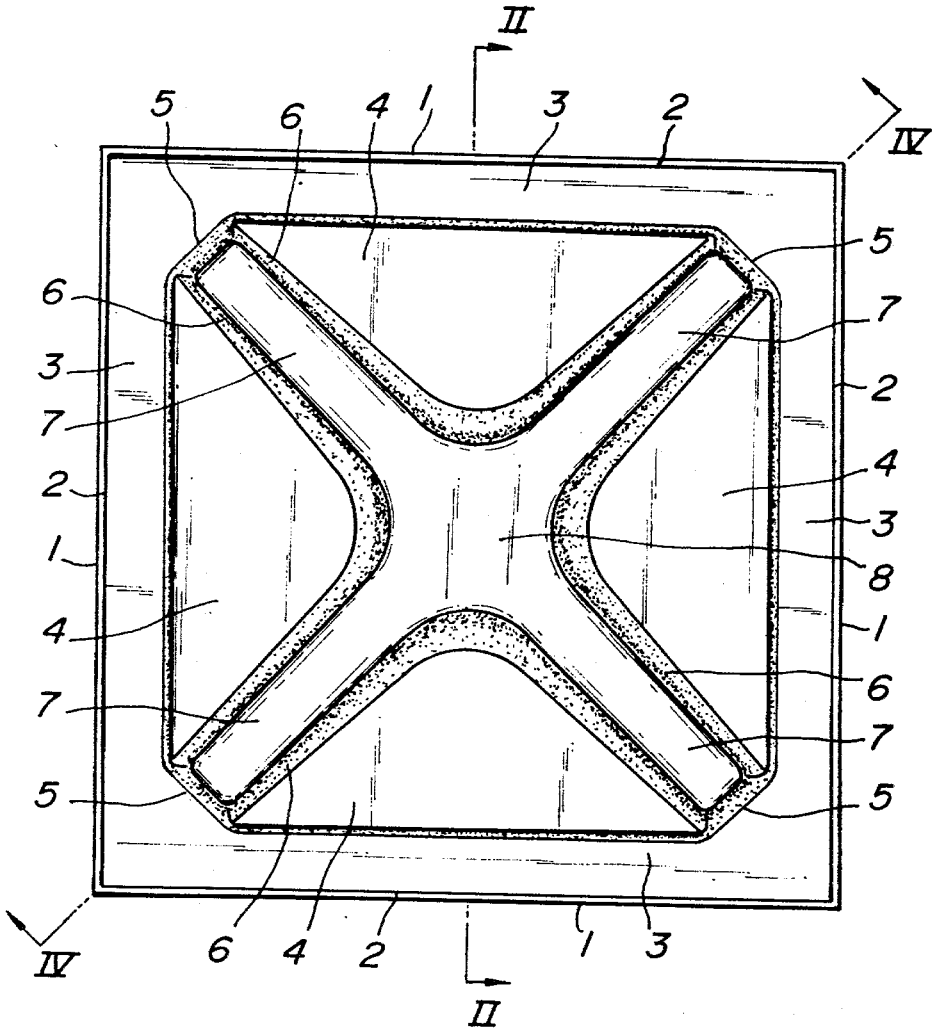
FIG. 1 is a plan view of one embodiment of the square steel panel according to the invention.
Figure 4:
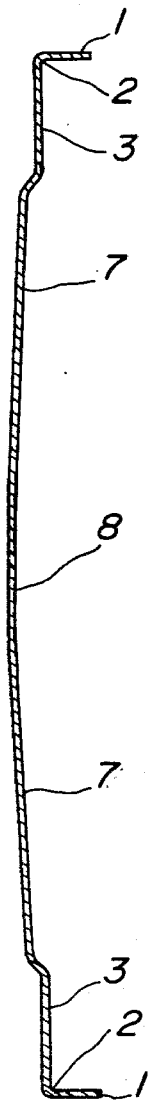
FIG. 4 is a sectional view of the panel taken along the line IV—IV in FIG. 1 or 5.
Figure 2:
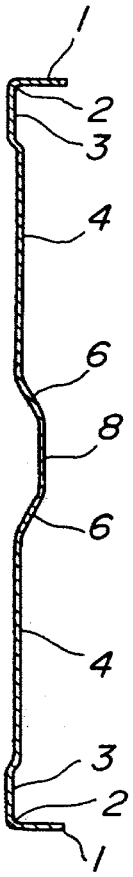
FIG. 2 is a sectional view of the panel taken along the line II—II in FIG. 1 or 5, illustrating flanges extending in the same direction as that of the reinforcing ribs of the panel.
Figure 5:
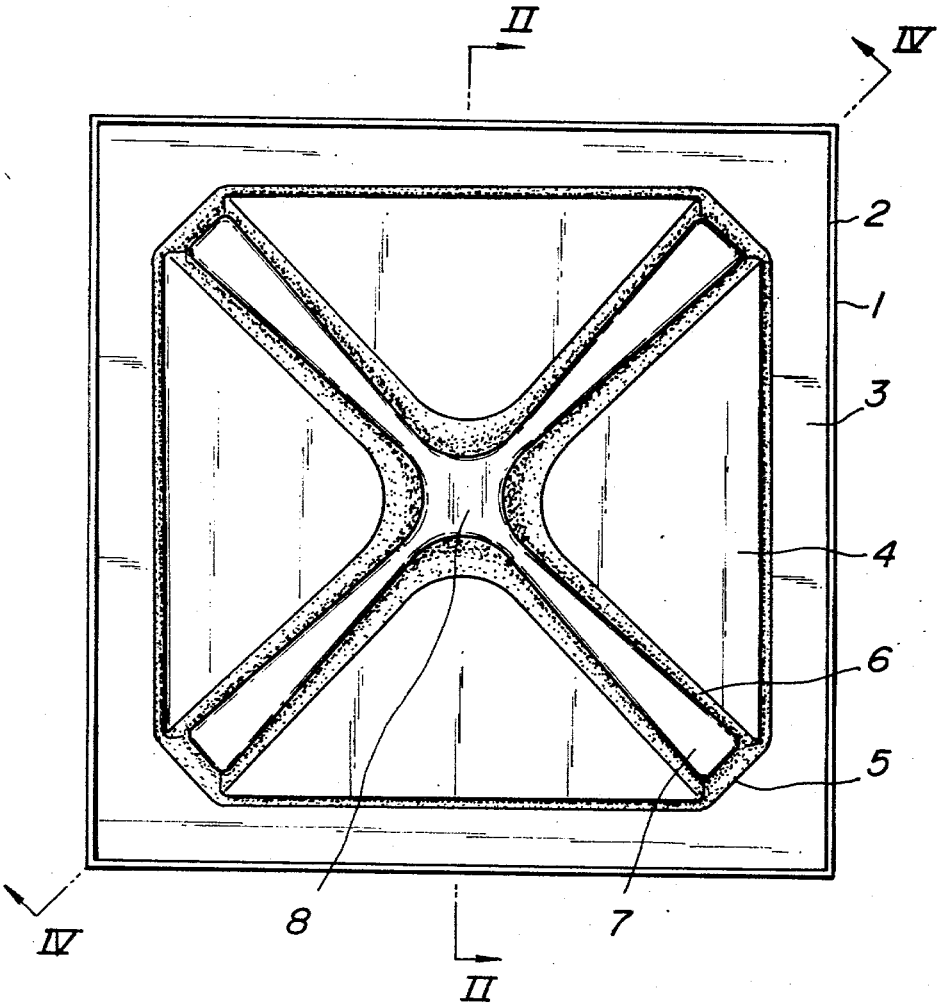
FIG. 5 is a plan view of another embodiment of the square steel panel according to the invention.

FIG. 1 is a plan view of a high pressure resistant steel square panel showing a first embodiment of the invention, whose pressure receiving surface is square which is the most typical configuration. The pressure receiving square surface consists of a bottom portion 3 along bottom edges 2 of flanges 1, flat portions 4 inside the bottom portion 3 and reinforcing ribs. Boundary lines between the bottom portion 3 and the flat portions 4 are formed substantially in parallel with the bottom portions 2 of the flanges 1. The boundary lines at corners 5 are arcuate or similar thereto as shown in FIG. 1 which is advantageous in view of the strength of the panel. The flat portions 4 are 5–20 mm, preferably 8–12 mm higher than the bottom portion 3 to form shoulders as shown in FIG. 2 which serve to decrease deformations of the pressure receiving surfaces and reduce stresses acting thereupon. The flat portions 4 are formed with reinforcing ribs which are of X-shaped as viewed in the plan view from the proximity of the corners 5 to a center 8 of the panel. The reinforcing ribs progressively increase their heights from the corners 5 toward the center 8 along the X-shape to form suitably inclined walls 6 those tilted angles correspond to the extent of the heights of the ribs. According to the invention it is preferable to provide widened surfaces 7 on the reinforcing ribs in order to more effectively reduce the deformations and stresses acting upon the pressure receiving surface of the panel. The widened surfaces 7 are shown in FIG. 1 having a constant width over from the corners 5 to the center 8. As shown in FIG. 5, a second embodiment, the widened surfaces 7 may be narrowed progressively toward the center 8 and correspondingly thereto the boundary lines between the inclined surfaces 6 and the flat portions 4 are progressively brought close to diagonal lines connecting the corners 5, thereby enabling the flat portions 4 to be broader which are advantageous for securing water supply and drain pipes. As above described, the reinforcing ribs are formed higher as they approach the center 8 to be substantially flatly arcuate in section along the diagonal lines as shown in FIG. 4 which are preferable for keeping the high strength of the panel. In this embodiment, therefore, the reinforcing ribs comprise the inclined surfaces 6, the widened surfaces 7 and the center 8.

Figure 3:
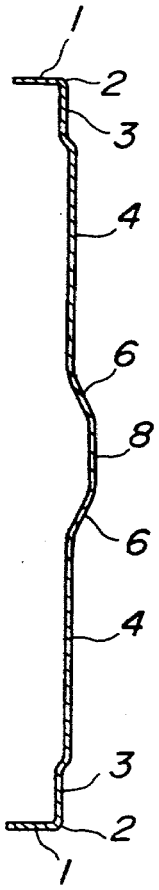
FIG. 3 is a sectional view similar to the panel shown in FIG. 2 with exception of flanges extending in a direction opposite to that of the reinforcing ribs of the panel.

According to the invention, the panels having the flanges 1 extending in the same direction as that of the reinforcing ribs as shown in FIG. 2 are generally used for side wall panels of the tank and the panels including the flanges 1 extending in the opposite direction as shown in FIG. 3 are used for bottom wall panels and ceiling wall panels.

Figure 6:
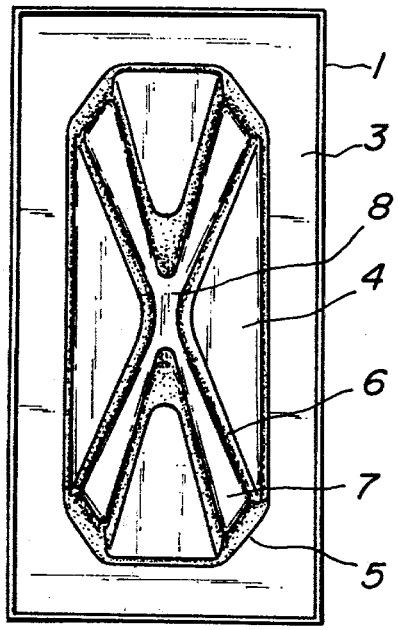
FIG. 6 is a plan view of a rectangular panel comprising a third embodiment of the invention.

The panels above described are square in configuration which are most commonly used for the panel assembled tank according to the invention. FIG. 6 illustrates third embodiment with a rectangular panel according to the invention which has the same effect as in the square panels. The rectangular panels having a ratio of long side to short side in length of 2:1 or 3:2 are preferably used in consideration of the efficiency in assembling the tank.

The panels according to the invention are constructed as above described. An allowable hydraulic pressure test was carried out to ascertain the effect of the present invention as to panel assembled water tanks consisting of square steel panels having the crosssection as shown in FIGS. 2 and 5, respective sides of 1 m and thickness of 6 mm as an example of the panels of the present invention. As the result, it has been found that the stresses and deformations of the pressure receiving surfaces of the panels according to the invention are much smaller than those of the panels reinforced by ribs in the prior art, so that the panels according to the invention are strong enough to be used as unit panels for panel assembled water tanks having heights of 6–7 mm.

While the invention has been particularly shown and described with reference to preferred embodiments thereof, it will be understood by those skilled in the art that the foregoing and other changes in form and details can be made therein without departing from the spirit and scope of the invention.

We claim:

1. In a pressure resistant panel receiving a uniform loading by hydraulic pressure and made of steel, cast iron and the like, including reinforcing ribs extending from corners to a center of said panel to form a substantially X-shaped rib as viewed in a plane of the panel, and flanges extending in a uniform height along peripheral edges of a pressure receiving surface of the panel, the improvement comprising, a bottom portion along bottom edges of said flanges of said pressure receiving surface and flat portions slightly higher than and inside said bottom portion, said reinforcing ribs being formed progressively higher from said corners toward the center of the panel.

2. A pressure resistant panel as set forth in claim 1, wherein said reinforcing ribs include at their tops widened surfaces to form inclined walls between the widened surfaces and said flat portions.

3. A pressure resistant panel as set forth in claim 2, wherein said widened surfaces are narrowed progressively toward said center of the panel.

4. A pressure resistant panel as set forth in claim 3, wherein boundary lines between said inclined surfaces and the flat portions are progressively brought close to diagonal lines connecting said corners to widen the flat portions as much as possible.

5. A pressure resistant panel as set forth in claim 1, wherein said reinforcing ribs have substantially flatly arcuate in section along diagonal lines.

6. A pressure resistant panel as set forth in claim 1, wherein said flanges extend in the same direction as that of said reinforcing ribs with respect to the plane of the panel.

7. A pressure resistant panel as set forth in claim 1, wherein said flanges extend in a direction opposite to that of said reinforcing ribs with respect to the plane of the panel.

8. A pressure resistant panel as set forth in claim 1, wherein said panel is rectangular in configuration.

9. A pressure resistant panel as set forth in claim 8, wherein a ratio of a long side to a short side of the rectangular panel in length is 2:1.

10. A pressure resistant panel as set forth in claim 8, wherein a ratio of a long side to a short side of the rectangular panel in length is 3:2.

11. A pressure resistant panel as set forth in claim 1, wherein said flat portions are 5–20 mm higher than said bottom portion.

12. A pressure resistant panel as set forth in claim 1, wherein said flat portions are 8–12 mm higher than said bottom portion.

13. A pressure resistant panel as set forth in claims 1, 2, 3, 4, 5, 6, 7, 11 or 12 wherein said panel is square in configuration.

* * * * *